United States Patent [19]

Patrick

[11] Patent Number: 4,723,759

[45] Date of Patent: Feb. 9, 1988

[54] WELDED WIRE FENCE PANEL

[75] Inventor: Bruce J. Patrick, Orange, Calif.

[73] Assignee: Davis Walker Corporation, Los Angeles, Calif.

[21] Appl. No.: 942,721

[22] Filed: Dec. 17, 1986

[51] Int. Cl.[4] ..... B21F 27/00; E04H 17/16

[52] U.S. Cl. ..... 256/22; 256/34

[58] Field of Search ..... 256/21, 22, 33, DIG. 5, 256/34; 72/64

[56] References Cited

U.S. PATENT DOCUMENTS

| | | | |
|---|---|---|---|
| 473,028 | 4/1892 | Stewart et al. | 256/22 |
| 3,092,372 | 6/1963 | Cougle | 256/22 |
| 3,158,258 | 11/1964 | Kelday et al. | 72/64 |
| 3,339,895 | 9/1967 | Kusel et al. | 256/22 |
| 4,553,740 | 11/1985 | Bailey | 256/33 |

FOREIGN PATENT DOCUMENTS

| | | | |
|---|---|---|---|
| 483472 | 11/1954 | Italy | 72/64 |
| 8740 | 7/1908 | United Kingdom | 256/DIG. 5 |
| 1032475 | 6/1966 | United Kingdom | 256/33 |

*Primary Examiner*—Andrew V. Kundrat

*Attorney, Agent, or Firm*—Christie, Parker & Hale

[57] ABSTRACT

A welded wire panel, which can be used to make fences, is made of welded wires which have been cold-drawn into a noncircular cross sectional shape, the orientation of which varies helically along the length of the wire. Each such wire has cold-drawn characteristics substantially throughout its structure and over its whole surface. A first set of the wires extends vertically with adjacent wires spaced far enough apart to prevent a child from getting a foothold for climbing. The vertical wires are welded to horizontal cross wires, which are spaced far enough apart in the vertical direction to avoid giving a child a step for climbing the panel.

2 Claims, 7 Drawing Figures

WELDED WIRE FENCE PANEL

BACKGROUND OF THE INVENTION

1. Field of the Invention

This invention relates to welded wire mesh panels which can be used to make fences which are sturdy, economical, attractive, and difficult for children to climb.

2. Description of the Prior Art

Welded wire mesh fence panels have been known for a number of years. For example, U.S. Pat. No. 3,423,072, issued Jan. 29, 1969, to Bernstein for "Demountable Structural Assembly" discloses welded wire mesh panels which may be connected to a series of upright posts to form a fence. Such prior art panels are made of upright steel wires of circular cross section welded to horizontal steel wires. To provide a sturdy fence made of such panels, the wires must be of relatively large diameter, or else the horizontal and vertical wires must be relatively closely spaced throughout the panel. The larger diameter wires make the fence expensive, and the closely-spaced grid pattern of smaller wires makes such fences easy for small children to climb.

Fences have also been made from wrought iron wire of noncircular cross section which has been helically twisted about its longitudinal axis. Such twisting sets up objectionable torsional stresses in the wire and tends to distort the grain flow lines so that the advantages of cold-drawn wire are lost. Consequently, such wire must have a relatively large noncircular cross section to provide a sturdy fence. Such construction uses a relatively large amount of steel or iron and produces fairly heavy panels which are difficult to handle and install. In addition, wrought iron wire must be relatively soft and have a fairly high carbon content, which precludes welding the wires together to form a welded wire fence panel.

SUMMARY OF THE INVENTION

I have found that an improved welded wire fence panel can be made of weldable wires which have been cold-drawn into a noncircular cross sectional shape, the orientation of which varies helically along the length of the wire. Each such wire has cold-drawn characteristics substantially throughout its structure and over its whole surface. U.S. Pat. No. 3,158,258, issued Nov. 24, 1964, to Kelday et al discloses such wire and apparatus for cold-drawing it. In accordance with my invention, the wire has a composition which makes it weldable so that, after it is drawn into its noncircular cross section shape, it can be welded into an improved fence panel which permits the use of about twenty percent less steel, and which has greater strength and rigidity than one made with the same geometry and made of circular wire stock from which the noncircular wire is drawn.

This invention provides a fence panel made of welded wires which have been cold-drawn into a generally noncircular cross sectional shape, the orientation of which varies helically along the length of the wire. Thus, each wire has cold-drawn characteristics substantially thoughout its structure and over its whole surface.

The panel includes a series of upright wires of the type just described, with at least one upper transverse wire of the same type disposed across the upright wires adjacent their upper ends. The transverse wire is welded to each of the upright wires.

At least one lower transverse wire is disposed across the upright wires adjacent their lower ends. The lower transverse wire is welded to each of the upright wires.

To increase the rigidity of the panel at its upper and lower edges, preferably an upper set of a plurality of transverse wires are disposed across the upright wires adjacent their upper ends, and each transverse wire in the upper set is welded to each of the upright wires. To increase the rigidity of the lower edge of the panel, a lower set of transverse wires are disposed across the upright wires adjacent their lower ends, and each transverse wire in the lower set is welded to each of the upright wires.

To make the fence panel difficult for a child to climb, the space between adjacent upright wires is about equal to the width of a child's foot, and the vertical space between the lowest upper transverse wire and highest lower transverse wire is at least about three feet to avoid providing steps by which a child might climb the panel.

DETAILED DESCRIPTION OF THE INVENTION

Figure 1:
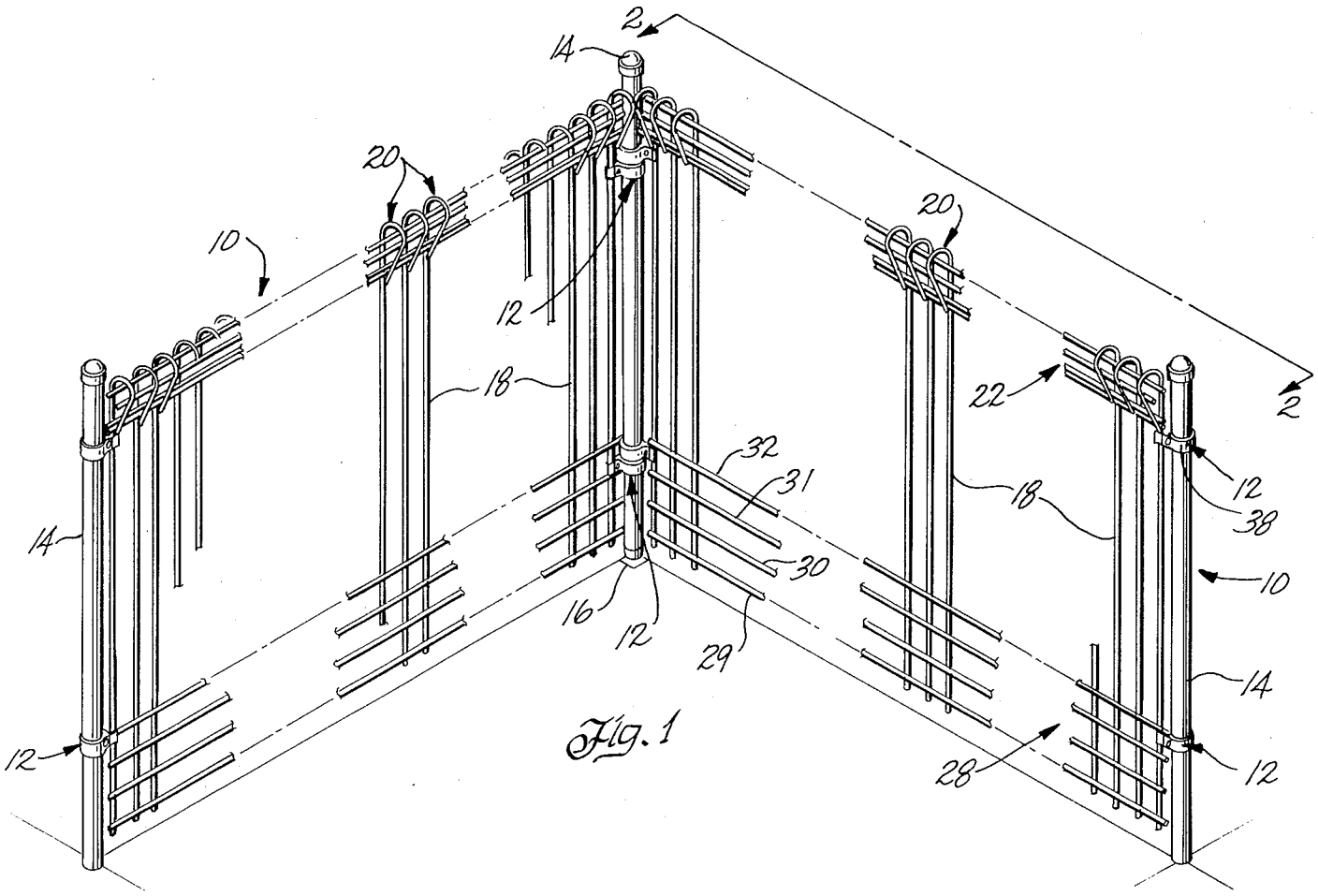
FIG. 1 is an isometric view of one corner of a fence made by using a pair of fence panels of the present invention.
Figure 2:
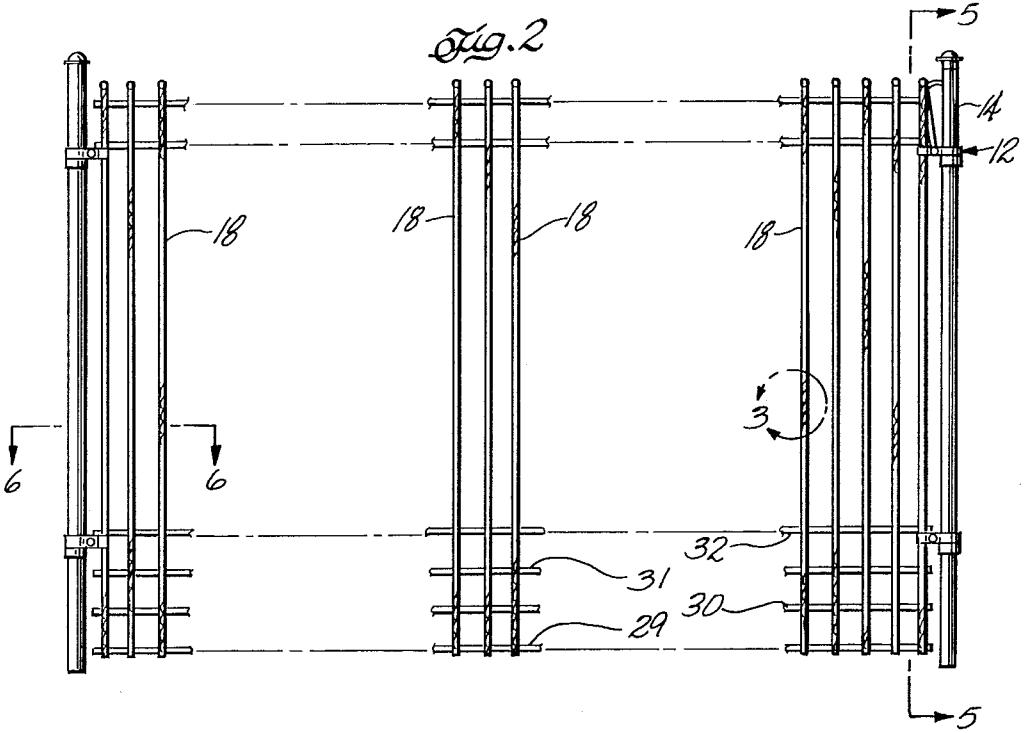
FIG. 2 is an elevation of one of the fence panels taken along 2—2 of FIG. 1.

Referring to FIG. 1, a pair of vertical rectangular fence panels 10 extending at right angles to each other are each connected at their adjacent ends by a respective pair of upper and lower clamps 12 to a common upright fence post 14, the lower end of which is mounted in a post support 16. Respective pairs of claims 12 secure the other respective end of each panel to a separate respective upright fence post 14.

Figure 5:
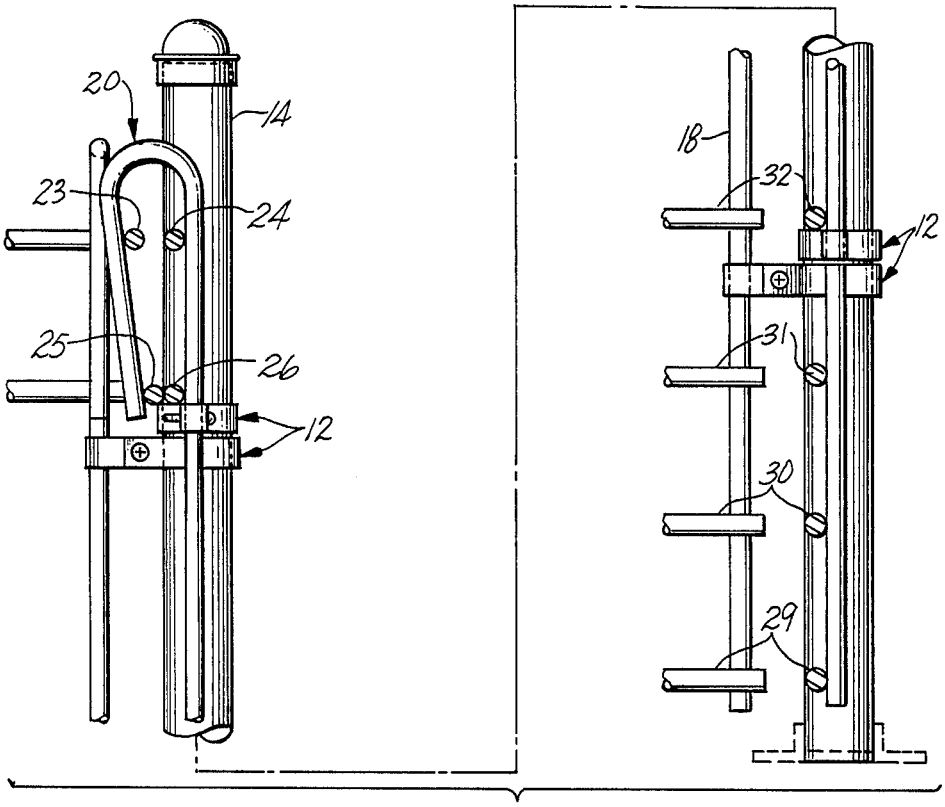
FIG. 5 is a view taken on line 5—5 of FIG. 2.

Each fence panel includes a plurality of vertical wires 18, the upper end of each of which is bent through 180° to form a respective loop 20, with each loop lying in a respective plane perpendicular to the major plane of the fence panel. An upper set 22 of four horizontal wires 23, 24, 25, and 26 are each welded to the interior surface of each loop. Wires 23 and 24 lie in the same horizontal plane and are each welded to the interior surface of the respective loops at a location above wires 25 and 26, which lie in a common horizontal plane and are welded together, as shown in FIG. 5.

A lower set 28 of four horizontal wires 29, 30, 31, and 32 are each welded at equally spaced vertical intervals adjacent the lower ends of the respective vertical wires 18. The lowest wire 29 in the lower set is welded to the vertical wires about one wire-diameter above their respective lower extremities. The second lowest wire 30 of the lower set is welded to the vertical wires about 3 to about 6 wire-diameters above the lowest wire 29. The third highest wire 31 in the lower set of horizontal wires is welded to the vertical wires about 3 to about 6 wire-diameters above the lower adjacent wire 30, and the uppermost wire 32 of the lower set is welded to the vertical wires at a distance of about 3 to about 6 wire-diameters above the adjacent wire 31.

The horizontal wires in the upper and lower sets are of the same length, and each project at their respective ends about one wire-diameter beyond the last vertical wire at each end of the panel.

The spacing between adjacent vertical wires is about equal to the width of a child's foot, or about 2½ to about 4 inches apart. The unobstructed vertical distance between the highest horizontal wire 32 in the lower set and the lowest horizontal wire in the upper set is between about 8 and about 10 times the spacing between adjacent wires in the lower set. For a fence panel made in accordance with this invention to be difficult for a child to climb, the unobstructed vertical distance between the lowest horizontal wire in the upper set and the highest horizontal wire in the lower set, is at least about 3 feet to provide a step that is too difficult for most children to climb.

Figure 6:
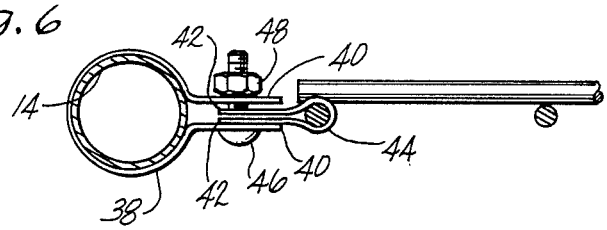
FIG. 6 is a view taken along line 6—6 of FIG. 2.

As shown in FIGS. 5 and 6, the clamps 12 used to secure the ends of the panels to upright posts include a large C-clamp 38, which makes a snug fit around a respective post 14. Each large C-clamp includes a pair of outwardly extending opposed ears 40 which fit over matching ears 42 of a small C-clamp 44, which makes a snug fit around an intermediate portion of an end vertical wire in a panel. A bolt 46 extends through matching bores (not shown) in the overlapping ears, and a nut 48 on the bolt binds the ears securely together so that each end of a panel is rigidly secured to a respective upright post.

Figure 7:
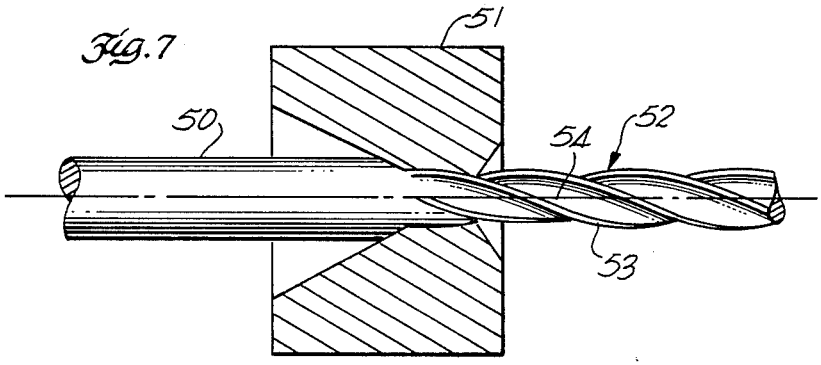
FIG. 7 is a cross section showing round stock wire being cold-drawn through a die and into the shape in which the wire is used to make the welded wire panel of this invention.

Referring to FIG. 7, to form each of the wires in the panels, round stock wire 50 (FIG. 7) is drawn through a die 51 (which may be of the type disclosed in U.S. Pat. No. 3,158,258) to form a cold-drawn wire 52 into a generally noncircular cross sectional shape, the orientation of which varies helically along the length of the wire, and which has cold-drawn characteristics substantially throughout its structure and over its whole surface.

Figure 4:
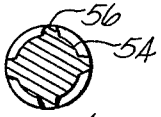
FIG. 4 is a view taken on line 4—4 of FIG. 3 showing a cross section of the wire used to make the welded wire panel of this invention.
Figure 3:
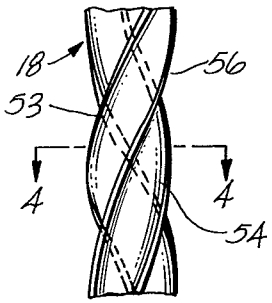
FIG. 3 is an enlarged view of an upright wire in the area of 3—3 of FIG. 2.

FIG. 4 is a cross section of the cold-drawn wire showing four longitudinally extending helical ridges 53 equally spaced around the wire. A separate respective groove 54 is formed between adjacent ridges. The crest dimension of the cold-drawn wire is the maximum distance between outer extremities of diametrically opposed ridges 53 lying in a common plane perpendicular to the longitudinal axis of the wire. The root dimension of the cold-drawn wire is the maximum distance between the outer surfaces of diametrically opposed grooves.

A fence panel can be made in accordance with this invention by using cold-drawn wire made from round stock steel wire having a diameter of 0.335" and drawn as shown in FIG. 7 to form a cold-drawn wire with a crest diameter of 0.305" and a root diameter of 0.254". Cold-drawn wire formed as just described has a weight about one-third less per unit length than that of the round stock wire from which it was drawn, and has improved strength and rigidity so that, when welded to form a fence panel, the result is a fence panel which uses less steel and yet has greater rigidity and strength than one formed from round stock wire from which the cold-drawn wire was made.

The composition of the steel wire using this invention is such that it is weldable. Such compositions are well known to those skilled in the art. For example, a typical steel wire is AISI 1025, which has the following composition:

| Component | % by Weight |
|---|---|
| Iron | 99.38–98.83 |
| Carbon | .22–.28 |
| Manganese | .30–.60 |
| Silicon | .10–.20 |
| Phosphorus | .04 (maximum) |
| Sulfur | .05 (maximum) |

A fence made of the panels in accordance with this invention, and as shown in FIG. 1, has the advantage of relatively high strength and rigidity compared to fence panels using as much as 50% more steel in their construction. The cold-drawn helically-shaped wires are not as easily deflected as round wires of equal or even greater weight per unit of length and, therefore, provide greater security and safety than welded wire panels made of round wire.

I claim:

1. A fence panel comprising:

(a) a series of upright wires in a common plane, each wire having been cold-drawn into a generally noncircular cross sectional shape, the orientation of which varies helically along the length of the wire, and each wire having cold-drawn characteristics substantially throughout its structure and over its whole surface;

(b) at least one upper transverse wire disposed across the upright wires adjacent their upper ends, the upper transverse wire being welded to each of the upright wires;

(c) at least one lower transverse wire disposed across the upright wires adjacent their lower ends, the lower transverse wire being welded to each of the upright wires, the unobstructed vertical distance between the lowest upper transverse wire and the highest lower transverse wire being at least about three feet, and at least several times greater than the space between adjacent upright wires, the lower transverse wire being welded to the lower end of each respective upright wire and spaced from the lower end of the upright wire by a distance no more than about the diameter of the upright wire;

(d) each upright wire having a loop formed at its upper end, and the upper transverse wire passes through each respective loop; and (e) a pair of upper transverse wires extending through each respective loop and each welded to the inside of the loop at the same height, the two upper transverse wires being welded together.

2. A fence panel according to claim 1 which includes two additional upper transverse wires welded to opposite sides of the loop above the two transverse wires welded together.

* * * * *